US007977879B2

(12) United States Patent
Kwon

(10) Patent No.: US 7,977,879 B2
(45) Date of Patent: Jul. 12, 2011

(54) PLASMA DISPLAY PANEL

(75) Inventor: Gijin Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 378 days.

(21) Appl. No.: 12/177,924

(22) Filed: Jul. 23, 2008

(65) Prior Publication Data

US 2009/0045743 A1 Feb. 19, 2009

(30) Foreign Application Priority Data

Aug. 14, 2007 (KR) ..... 10-2007-0081883

(51) Int. Cl.
*H01J 17/49* (2006.01)

(52) U.S. Cl. ..... 313/582; 313/586

(58) Field of Classification Search ..... 313/582–587
See application file for complete search history.

(56) References Cited

U.S. PATENT DOCUMENTS

| | | | | |
|---|---|---|---|---|
| 6,008,582 | A * | 12/1999 | Asano et al. | 313/582 |
| 2003/0015963 | A1 * | 1/2003 | Tanaka | 313/582 |
| 2004/0046504 | A1 | 3/2004 | Yonehara et al. | |
| 2006/0043894 | A1 * | 3/2006 | Kim et al. | 313/586 |
| 2006/0061278 | A1 | 3/2006 | Jung et al. | |
| 2006/0076888 | A1 | 4/2006 | Woo | |
| 2006/0091802 | A1 * | 5/2006 | Hong et al. | 313/582 |
| 2008/0116796 | A1 * | 5/2008 | Kwon et al. | 313/582 |

FOREIGN PATENT DOCUMENTS

| | | |
|---|---|---|
| EP | 1 688 981 | 8/2006 |
| EP | 1 713 109 | 10/2006 |
| KR | 10-2004-0026209 A | 3/2004 |
| KR | 10-2006-0027516 A | 3/2006 |
| KR | 10-2006-0108924 A | 10/2006 |

OTHER PUBLICATIONS

European Search Report dated Dec. 16, 2008.
Korean Office Action dated Apr. 10, 2009.

* cited by examiner

*Primary Examiner* — Anne M Hines
(74) *Attorney, Agent, or Firm* — KED & Associates, LLP

(57) ABSTRACT

A plasma display panel is disclosed. The plasma display panel includes a first substrate and a second substrate positioned adjacent to each other, a first barrier rib positioned between the first substrate and the second substrate and partitioning a discharge area, a sealing portion attaching the first substrate to the second substrate, and an auxiliary barrier rib. The auxiliary barrier rib may be spaced apart from the sealing portion with a predetermined distance therebetween, extended from the first barrier rib, and may include a portion with a height lower than a height of the first barrier rib positioned in the discharge area.

41 Claims, 9 Drawing Sheets

PLASMA DISPLAY PANEL

This application claims priority to Korean Patent Application No. 10-2007-0081883 filed in Korea on Aug. 14, 2007, which is hereby incorporated by reference.

BACKGROUND

1. Field

A plasma display panel is disclosed herein.

2. Background

Plasma display panels are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION OF EMBODIMENTS

Reference will now be made in detail embodiments examples of which are illustrated in the accompanying drawings.

A plasma display panel generally includes a phosphor inside discharge cells partitioned by barrier ribs. When a driver supplies driving signals to electrodes of the plasma display panel, the phosphor is excited to emit light.

The plasma display panel represents a gray scale due to the combination of subfields. In other words, the plasma display panel emits light to the outside during each subfield, and a gray scale is represented due to a sum of the quantity of light emitted to the outside during each subfield.

Each subfield includes a reset period, an address period, and a sustain period. During the reset period, wall charges are uniformly distributed inside all of discharge cells of the plasma display panel. During the address period, discharge cells to emit light are selected. During the sustain period, light is emitted in the selected discharge cells.

There are several factors that cause noise when the plasma display panel is driven. The noise is an obstacle to a driving of the plasma display panel, and also reduces the structural quality of the plasma display panel.

The present application discloses various embodiments. One of ordinary skill in the art will recognize that features of the various embodiments can be combined to produce different plasma display panels. Further, the auxiliary barrier ribs disclosed herein can be utilized with stripe type barrier ribs, or other type barrier ribs, such as lattice type or well type.

Figure 1:
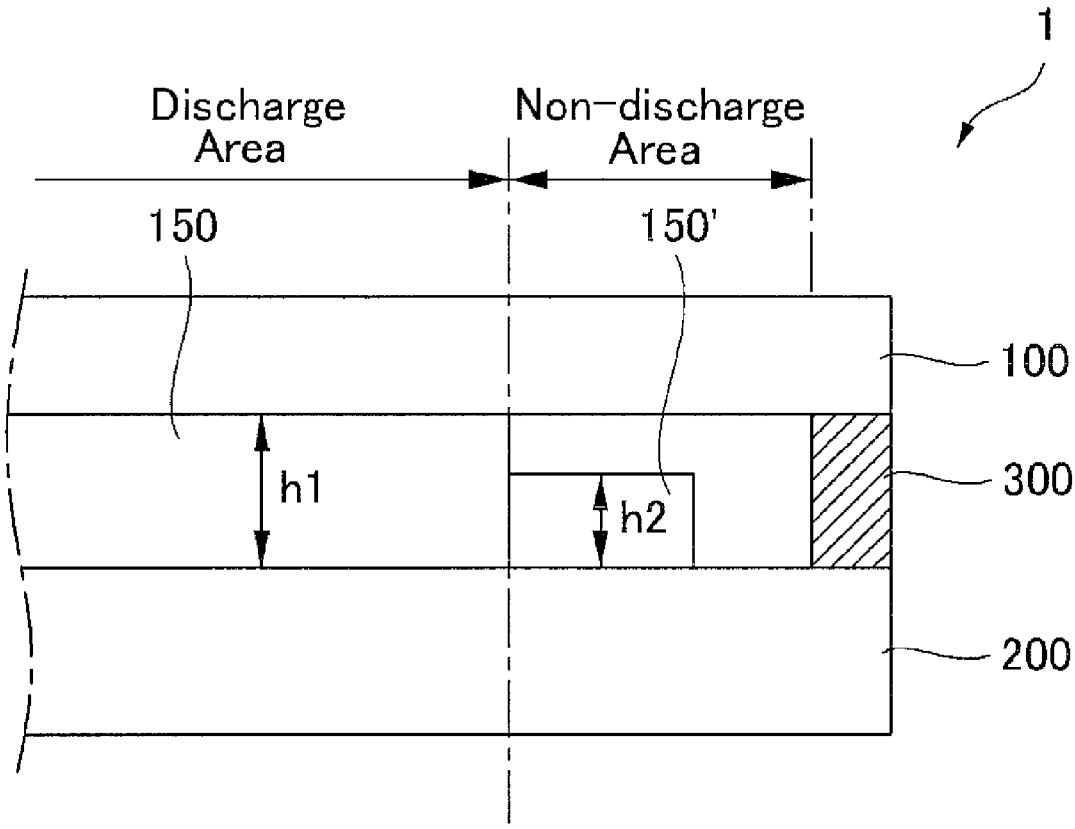
FIG. 1 illustrates structure of a barrier rib of a plasma display panel according to an embodiment.

FIG. 1 illustrates structure of a barrier rib of a plasma display panel according to an embodiment. As illustrated in FIG. 1, the plasma display panel 1 may include a first substrate 100, a second substrate 200, and a plurality of barrier ribs 150 and 150' positioned between the first substrate 100 and the second substrate 200. The first substrate 100 and the second substrate 200 may be made of a transparent material, and may be positioned parallel to each other to be spaced apart from each other with a predetermined distance therebetween. The plasma display panel 1 may include a sealing portion 300 used to seal the first and second substrates 100 and 200. The sealing portion 300 may be formed by coating a frit of a glass material along edges of the substrates 100 and 200. Although not shown, the plasma display panel 1 may include a scan electrode and a sustain electrode positioned on the first substrate 100, an address electrode positioned on the second substrate 200, a dielectric layer covering the electrodes, and a phosphor layer positioned inside a discharge space partitioned by the barrier ribs.

Discharge cells may be partitioned by the barrier ribs 150 and 150' between the first and second substrates 100 and 200. The discharge cells may be divided into a discharge area in which an image is displayed and a non-discharge area in which an image is not displayed. Although not shown, the first and second substrates 100 and 200 each may have a substantially rectangular form with long sides and short sides.

In one embodiment, the barrier rib 150 positioned in the discharge area may be defined as a first or main barrier rib, and the barrier rib 150' positioned in the non-discharge area may be defined as an auxiliary barrier rib 150'. The auxiliary barrier rib 150' may function as a noise prevention barrier rib. The first barrier rib(s) 150 may be positioned between the first and second substrate 200 in a direction of the long side and/or the short side of the first substrate 100 and/or the second substrate 200.

The auxiliary barrier rib(s) 150' may be extended from the first barrier rib(s) 150, and may be positioned to be spaced apart from the sealing portion 300 formed at the edge of the second substrate 200 with a predetermined distance therebetween. The auxiliary barrier rib(s) 150' may have a height h2 lower than a height h1 of the first barrier rib(s) 150.

The auxiliary barrier rib(s) 150' may prevent noise generated in the discharge area during a driving of the plasma display panel from being propagated to outside of the plasma display panel, and may improve an exhaust process characteristic when the plasma display panel is fabricated, because the auxiliary barrier rib(s) 150' are spaced apart from the sealing portion 300 with the predetermined distance therebetween. The auxiliary barrier rib(s) 150' may further improve the exhaust process characteristic because the height h2 of the auxiliary barrier rib(s) 150' is lower than the height h2 of the first barrier rib(s) 150.

The auxiliary barrier rib 150' may be extended from any first barrier rib 150 formed in a direction of the long side or the short side of the first and second substrates 100 and 200.

Examples of a formation process of the first barrier rib(s) 150 and the auxiliary barrier rib(s) 150' may include a photolithography process in which ultraviolet rays are irradiated using a photosensitive barrier rib material, a screen printing process in which a barrier rib material is printed on a substrate, and a direct etching process in which a photoresist is positioned on a barrier rib material and then ultraviolet rays are irradiated on the photoresist to perform an etching process. The first barrier rib(s) 150 and the auxiliary barrier rib(s) 150' may be formed using any formation process capable of forming a barrier rib.

The first barrier rib(s) 150 and the auxiliary barrier rib(s) 150' may be formed using different materials depending on their functions. However, the first barrier rib(s) 150 and the auxiliary barrier rib(s) 150' may be formed using the same material for a simple and easy formation process.

Figure 2A:
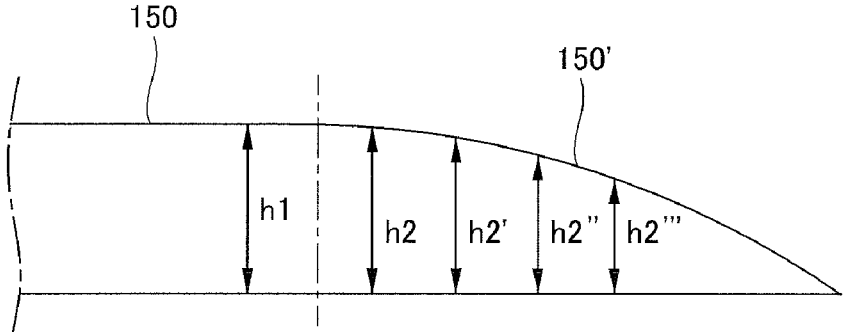
FIGS. 2A to 2C are cross-sectional views of structure of an auxiliary barrier rib according to an embodiment.
Figure 2B:
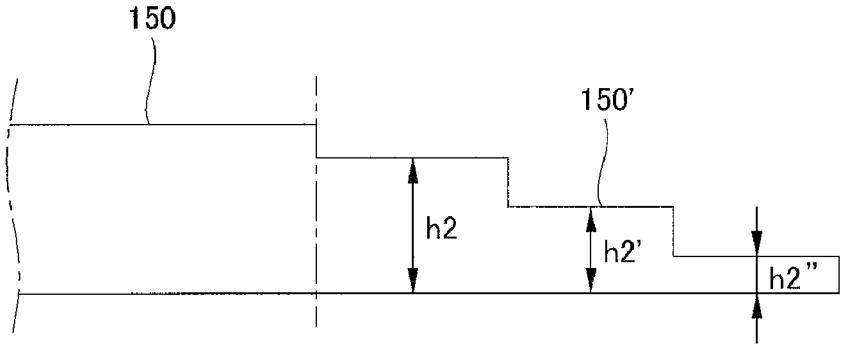
Figure 2C:
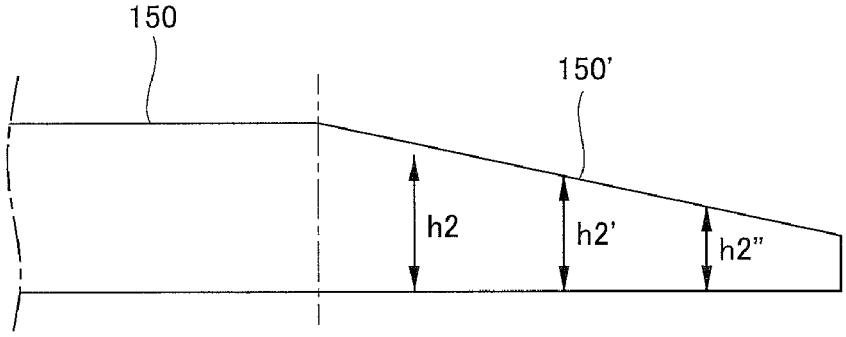

FIGS. 2A to 2C are cross-sectional views of structure of an auxiliary barrier rib according to an embodiment. The auxiliary barrier rib 150', which may be extended from the first barrier rib 150, as illustrated in FIG. 2A, may have a gradually decreasing height (i.e., h2>h2'>h2''>h2''', . . . ) as it extends toward the sealing portion 300. As illustrated in FIG. 2B, the height of the auxiliary barrier rib 150' may decrease stage by stage as the auxiliary barrier rib 150' extends toward the sealing portion 300. Further, as illustrated in FIG. 2C, the height of the auxiliary barrier rib 150' may linearly decrease and then may sharply decrease at an end of the auxiliary barrier rib 150' as the auxiliary barrier rib 150' extends toward the sealing portion 300.

The auxiliary barrier rib 150' is not limited to the above-described structure. It may have any structure as long as the auxiliary barrier rib 150' is extended from the first barrier rib 150. For instance, although not shown, the number of auxiliary barrier rib(s) 150' extended from one first barrier rib may be two. In such a case, the auxiliary barrier rib 150' may have a portion with the height lower than the height of the first barrier rib.

Figure 3:
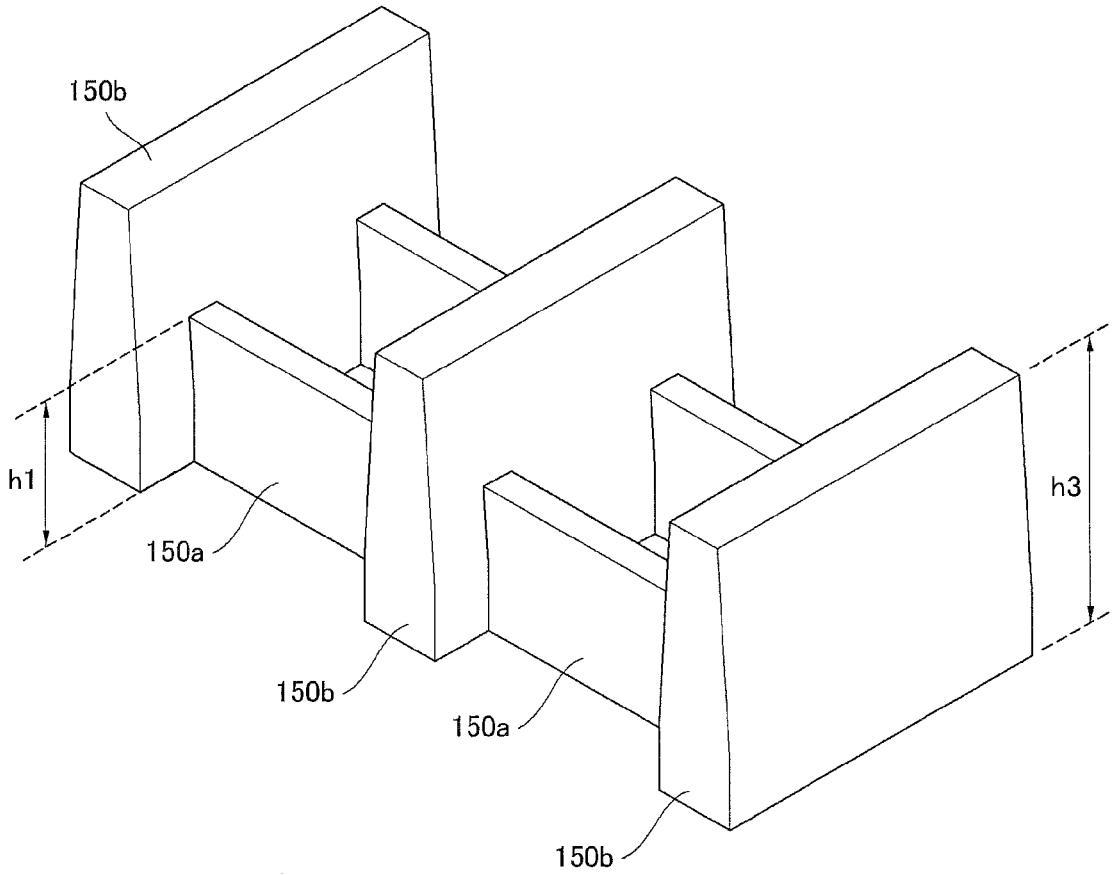
FIG. 3 is a perspective view of first barrier ribs according to an embodiment.

FIG. 3 is a perspective view of first barrier ribs according to an embodiment. As illustrated in FIG. 3, the first barrier rib(s) 150 positioned in the discharge area may include a plurality of first barrier rib portions 150*a* formed in a direction of a long side of the first and second substrates 100 and 200, and a plurality of second barrier rib portions 150*b* formed in a direction of a short side of the first and second substrates 100 and 200. A height h1 of the first barrier rib portions 150*a* may be lower than a height h3 of the second barrier rib portions 150*b*. In such a case, the auxiliary barrier ribs 150' may include a portion with the height h2 lower than the height h1 of the first barrier rib portions 150*a*. As above, when the heights of the first and second barrier ribs 150*a* and 150*b* are different from each other, an exhaust characteristic of the plasma display panel is further improved.

The outermost second barrier rib portion 150*b* among the second barrier rib portions 150*b* positioned in the discharge area may have a curvature in a direction of the non-discharge area. This may prevent a reduction in strength of the barrier rib, improving the structure of the barrier rib for noise prevention.

At least one auxiliary barrier rib may be formed parallel to the first barrier rib portion 150*a* and/or the second barrier rib portion 150*b* in the non-discharge area in which the first barrier rib 150 is not positioned. The auxiliary barrier rib may be formed in a form similar to a connection form of the first barrier rib 150 and the auxiliary barrier rib 150' as illustrated in FIGS. 2A to 2C. Further, the auxiliary barrier rib may be formed in a stripe form having a constant height similar to the first barrier rib 150. The auxiliary barrier rib may further reduce a noise generated when the plasma display panel is driven.

A dummy area may be formed between the discharge area with the first barrier rib 150 and the non-discharge area with the auxiliary barrier rib 150'. In the dummy area, discharge cells partitioned by dummy barrier ribs are positioned, but light is not emitted in the discharge cells positioned in the dummy area. The dummy area prevents noise generated in the discharge area from being propagated to outside of the plasma display panel. The dummy barrier rib may have a cross structure of the first and second barrier rib portions 150*a* and 150*b* each having the different height, or a stripe structure using only one barrier rib.

Figure 4A:
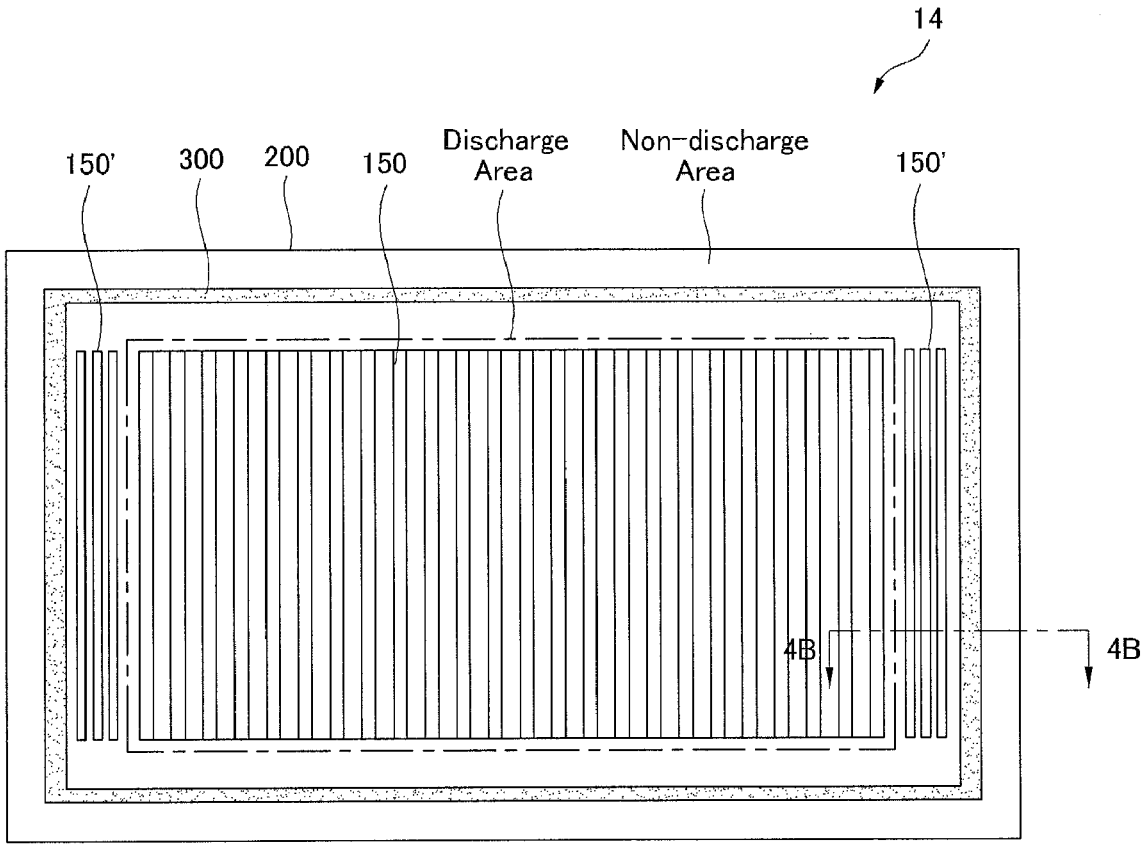
FIG. 4A illustrates first barrier ribs of a plasma display panel according to another embodiment.
Figure 4B:
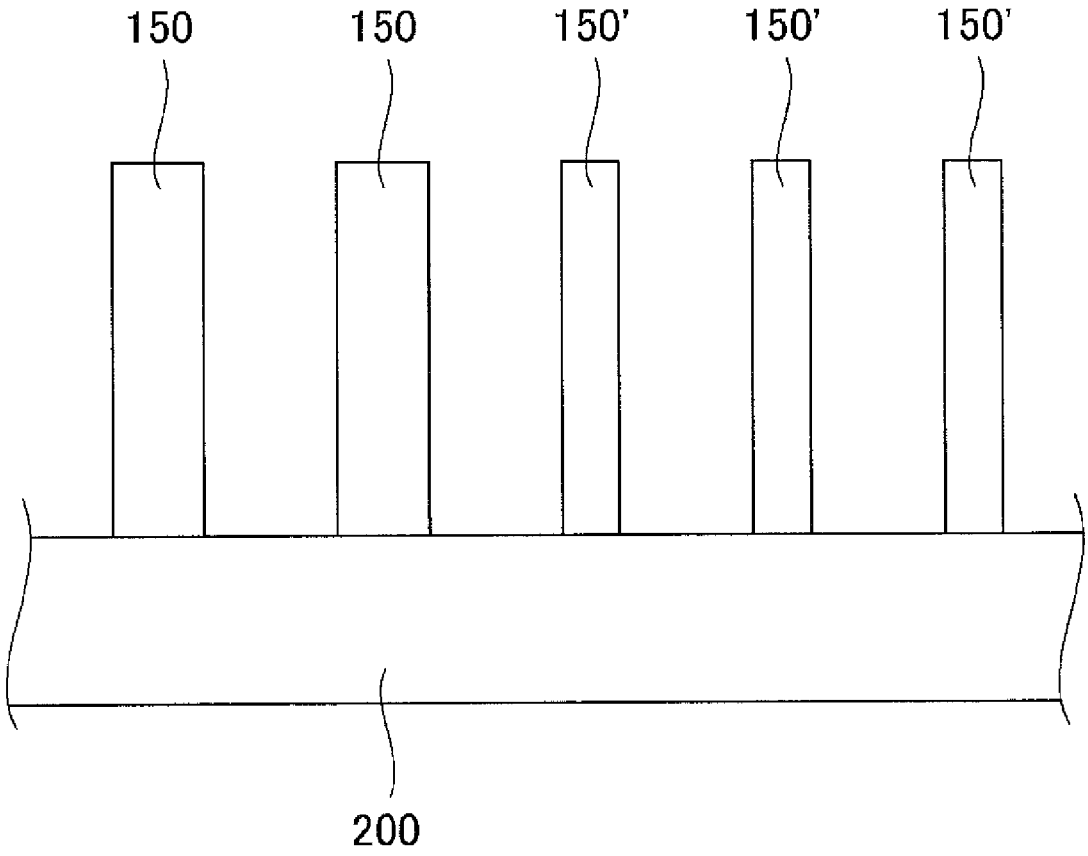
FIG. 4B is a cross-sectional view of a portion of the plasma display panel of FIG. 4A, taken along lines 4B-4B.

FIG. 4A illustrates structure of first barrier ribs of a plasma display panel according to another embodiment. FIG. 4B is a cross-sectional view of a portion of the plasma display panel of FIG. 4A, taken along line 4B-4B.

As illustrated in FIGS. 4A and 4B, the plasma display panel 14 includes a first barrier rib 150 positioned in a discharge area and an auxiliary barrier rib 150' positioned in a non-discharge area. The first barrier rib 150 may be a stripe type barrier rib positioned on a second substrate 200. Further, the height and width of the auxiliary barrier rib 150' positioned in the non-discharge area may be different or the same as the height and width of the first barrier rib 150. The embodiment of FIGS. 4A-4B show the auxiliary barrier rib 150' being shorter and narrower that the first barrier rib 150. Further, the spacing between adjacent auxiliary barrier ribs 150' may be different or the same as the spacing between adjacent first barrier ribs 150. Alternatively, the first barrier rib 150 may be a well type barrier rib including first and second barrier rib portions illustrated in FIG. 3. In such a case, a height of the second barrier rib portion may be higher than a height of the first barrier rib portion so as to improve an exhaust characteristic.

The auxiliary barrier rib 150' may be positioned parallel to the first barrier rib 150 in the non-discharge area, and may be spaced apart from a sealing portion 300 with a predetermined distance therebetween, as shown in FIG. 4A. The number of auxiliary barrier ribs 150' positioned in the non-discharge area may be one or more. The embodiment of FIGS. 4A and 4B shows 3 auxiliary barrier ribs 150'. When the first barrier rib 150 includes a first barrier rib portion and a second barrier rib portion having a height higher than a height of the first barrier rib portion, a height of the auxiliary barrier ribs 150' may be substantially equal to the height of the second barrier rib portion. Although not shown, the auxiliary barrier rib 150' may be positioned perpendicular to the first barrier rib 150 in the non-discharge area.

If the disposition structure of the auxiliary barrier rib 150' is explained based on a first substrate and the second substrate 200, the auxiliary barrier rib 150' may be positioned in a direction of a short side or a long side of the second substrate 200 in the non-discharge area. In this case, the auxiliary barrier rib 150' is positioned to be spaced apart from the sealing portion 300 with a predetermined distance therebetween.

A shape and a material of the auxiliary barrier rib 150' may be the same as those of the first barrier rib 150. The auxiliary barrier rib 150' may have a constant height along its entire length.

Alternatively, the embodiment of FIGS. 4A and 4B may be combined with the embodiments of FIG. 1 or FIG. 7, discussed hereinafter, such that the embodiment further includes a first barrier rib 150 having an auxiliary barrier rib 150' that extends or is spaced from one or both ends of the first barrier rib 150 and positioned in the non-discharge area.

Figure 5:
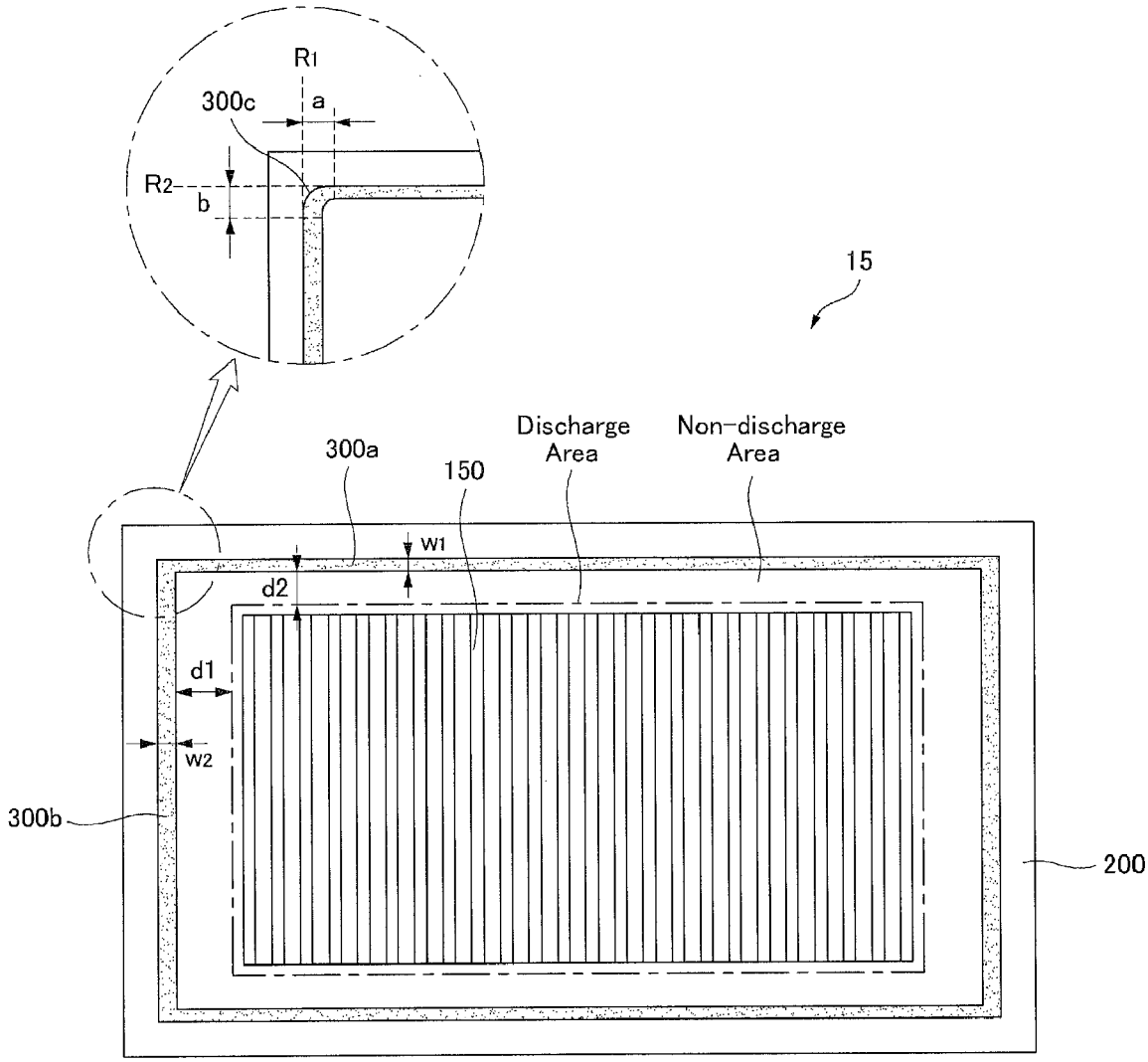
FIG. 5 is a plane view explaining a relationship between a sealing portion and barrier ribs of a plasma display panel according to an embodiment.

FIG. 5 is a plane view for explaining a relationship between a sealing portion and a barrier rib of a plasma display panel according to an embodiment. Referring to FIG. 5, the first barrier rib 150 may be positioned in the discharge area on the second substrate 200, and the sealing portion 300 may be positioned at an edge of the second substrate 200. The sealing portion 300 may include a first sealing portion 300*a* positioned in a direction of the long side of the second substrate 200, a second sealing portion 300*b* positioned in a direction of the short side of the second substrate 200, and a third corner sealing portion 300*c* formed at a contact position of the first sealing portion 300*a* and the second sealing portion 300*b*.

The sealing portions 300*a*, 300*b*, and 300*c* may prevent noise generated in the discharge area from being propagated to outside of the plasma display panel 15. Only, in the case that the auxiliary barrier rib 150' is positioned in a direction of the short side of the second substrate 200 as in the previous embodiment, the auxiliary barrier rib 150' may prevent noise generated in the direction of the short side of the second substrate 200. However, it may be insufficient for the auxiliary barrier rib 150' to prevent only noise generated in the direction of the long side of the second substrate 200. Accordingly, noises generated in all directions of the second substrate 200 may be prevented by setting a width W2 of the second sealing portion 300*b* to be larger than a width W1 of the first sealing portion 300*a*.

In this case, a distance d1 ranging from the second sealing portion 300*b* to the first barrier rib 150 may be longer than a distance d2 ranging from the first sealing portion 300*a* to an end of the first barrier rib 150. More specifically, the distance d1 may be equal to or less than about 2.5 times longer than the distance d2.

Although not shown, the auxiliary barrier rib may be positioned in the non-discharge area and may be extended from the first barrier rib. The distance d2 may be about 2 to 10 times a distance from the first sealing portion 300*a* to an end of the auxiliary barrier rib extended from the first barrier rib. In this case, a length of the auxiliary barrier rib extended from the first barrier rib 150 may be longer than the distance from the first sealing portion 300*a* to the end of the auxiliary barrier rib.

When the above-described relationships between the sealing portions 300*a*, 300*b*, and 300*c* and the first barrier rib(s) 150 are satisfied, noise may be prevented in a discharge area of the plasma display panel and, at the same time, the discharge area and the non-discharge area may be efficiently partitioned. Accordingly, an advantage (i.e., a margin) in a structural disposition of the plasma display panel may be improved due to the effective partition of the discharge area and the non-discharge area.

In particular, the third corner sealing portion 300*c* may have a structural weakness when the first and second substrates are attached. In other words, because the structure of the third corner sealing portion 300*c* may be weaker than the structure of the first or second sealing portion 300*a* or 300*b*, cracks may be generated in the third corner sealing portion 300*c*. The cracks may greatly affect the generation of noise. Accordingly, the third corner sealing portion 300*c* may be formed in a round form and may be connected to the first and second sealing portions 300*a* and 300*b*, thereby preventing cracks. In this case, a width W3 of the third corner sealing portion 300*c* may be larger than the width W2 of the second sealing portion 300*b*.

In FIG. 5, reference numeral "a" indicates a distance from a contact surface of the first sealing portion 300*a* and the third corner sealing portion 300*c* to an imaginary line R1 extended from the second sealing portion 300*b*. Reference numeral "b" indicates a distance from a contact surface of the second sealing portion 300*b* and the third corner sealing portion 300*c* to an imaginary line R2 extended from the first sealing portion 300*a*. A ratio of "a" to "b" may be 5:4 so as to further improve the structural weakness of the third corner sealing portion 300*c* and to prevent noise.

Figure 6A:
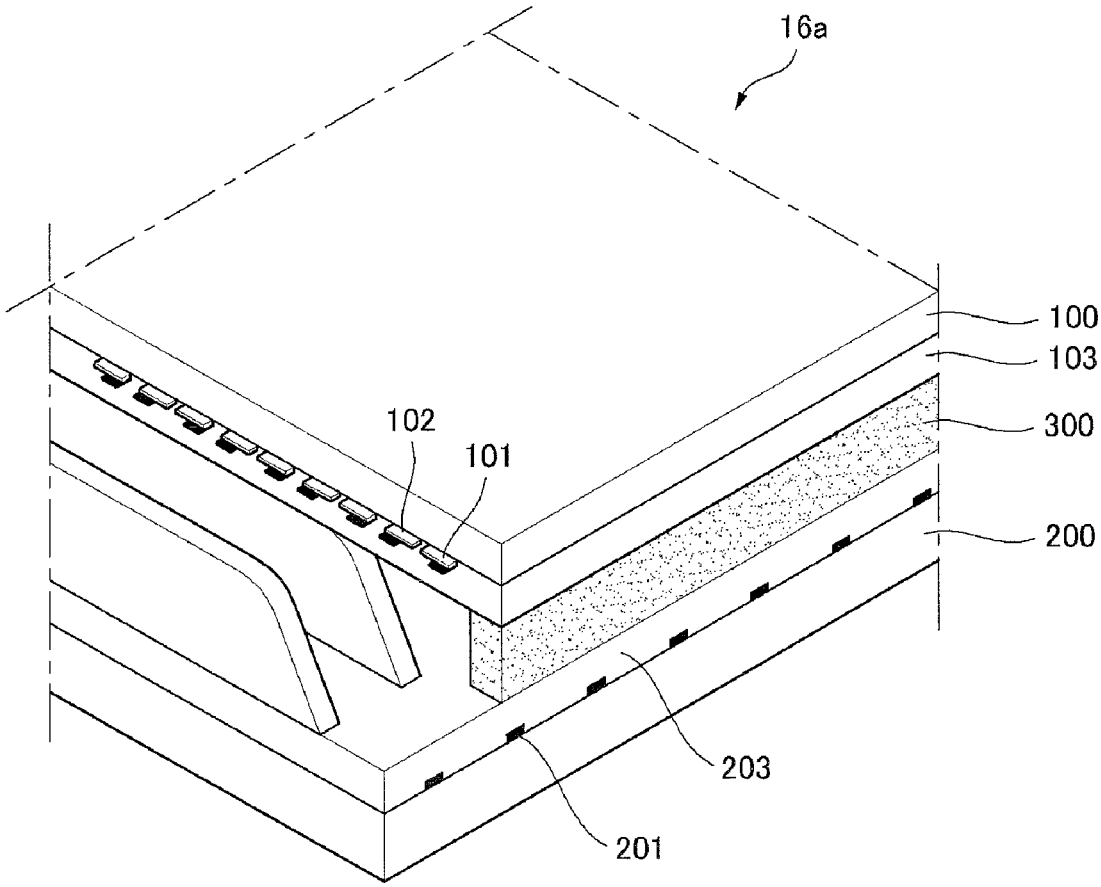
FIGS. 6A and 6B are cross-sectional views of a sealing portion according to additional embodiments.
Figure 6B:
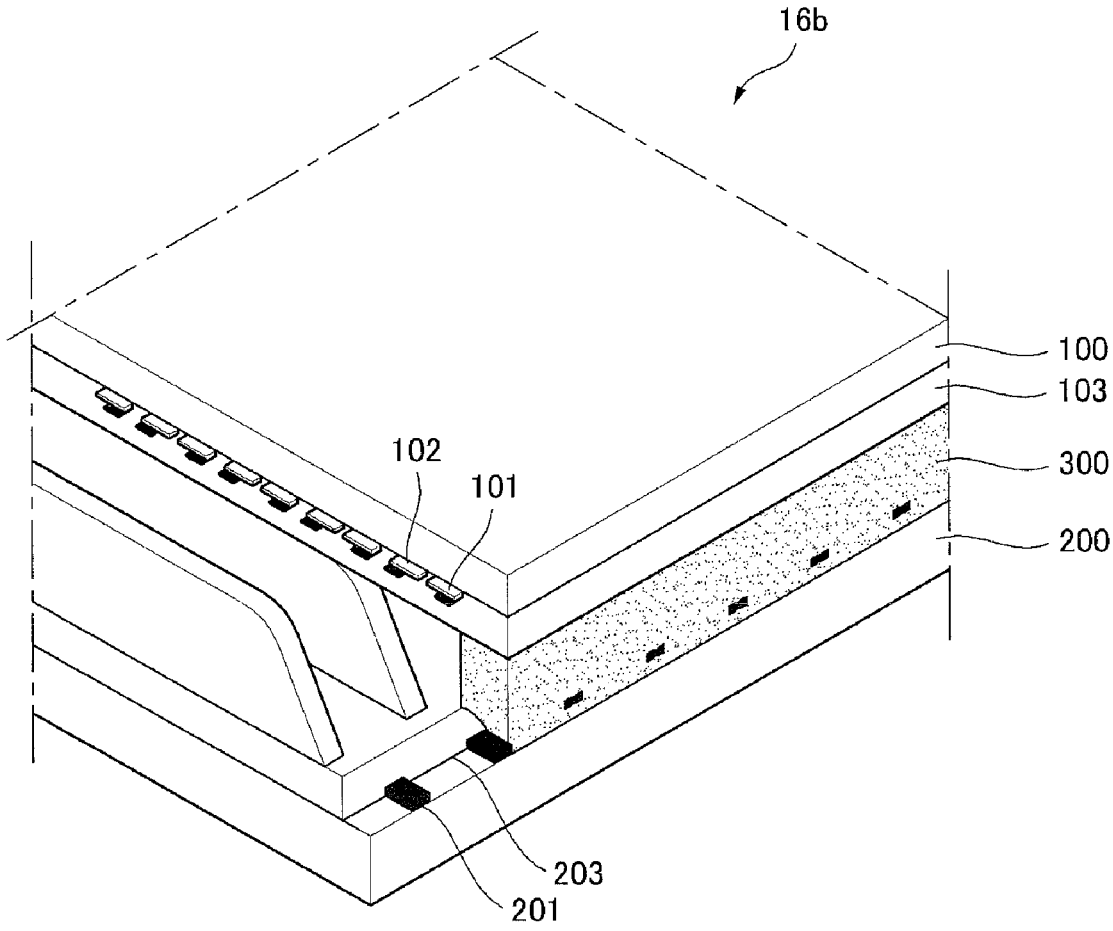

FIGS. 6A and 6B are cross-sectional views of a sealing portion according to another embodiment. As illustrated in FIG. 6A, the first substrate 100 and the second substrate 200 may be positioned to be spaced apart from each other with a predetermined distance therebetween. A plurality of scan electrodes 101 and a plurality of sustain electrodes 102 may be positioned parallel to each other on the first substrate 100, and an upper dielectric layer 103 may be positioned on the first substrate 100 to cover the plurality of scan electrodes 101 and the plurality of sustain electrodes 102. In this case, the upper dielectric layer 103 may cover an entire surface of the first substrate 100 on which the plurality of scan electrodes 101 and plurality of sustain electrode 102 are formed. Although not shown, the upper dielectric layer 103 may include a first layer positioned adjacent to the plurality of scan electrode 101 and the plurality of sustain electrode 102, and a second layer positioned on the first layer. The first layer may be formed by a screen printing method so that a dielectric paste covers the plurality of scan electrodes 101 and the plurality of sustain electrodes 102, and the second layer may be formed by a laminating method using a green sheet. A protective layer 104 made of MgO may be formed on the upper dielectric layer 103.

A plurality of address electrodes 201 may be positioned parallel to one another on the second substrate 200, and a lower dielectric layer 203 may be positioned on the second substrate 200 to cover the address electrodes 201. In this case, the lower dielectric layer 203 may cover an entire surface of the second substrate 200 on which the electrodes 201 are formed.

The position structures of the upper dielectric layer 103 and the lower dielectric layer 203 may be applied to the plasma display panel, or one of the position structures of the dielectric layers may be applied to the plasma display panel. Further, the first barrier rib 150 and the auxiliary barrier rib 150' illustrated in FIG. 1 may be positioned between the first substrate 100 and the second substrate 200.

The sealing portion 300 may directly contact each of the upper dielectric layer 103 covering the entire surface of the first substrate 100 and the lower dielectric layer 203 covering the entire surface of the second substrate 200 to attach the first substrate 100 to the second substrate 200. When the upper dielectric layer 103 or the lower dielectric layer 203 does not cover the entire surface of the first substrate 100 or the second substrate 200 (for instance, the upper dielectric layer 103 or the lower dielectric layer 203 is not formed on the first substrate 100 or the second substrate 200), the sealing portion 300 may directly contact the substrate on which the dielectric layer is not formed.

When the sealing portion 300 directly contacts at least one of the upper dielectric layer 103 or the lower dielectric layer 203, noise generated at a contact surface (i.e., an interface) between the sealing portion 300 and the substrate may be prevented. When the sealing portion 300 directly contacts all of the upper dielectric layer 103 and the lower dielectric layer 203, or does not contact all of the upper dielectric layer 103 and the lower dielectric layer 203, the sealing portion 300 may include beads to prevent noise generated at the interface between the sealing portion 300 and the substrates 100 and 200.

As illustrated in FIG. 6B, when the lower dielectric layer 203 covers a portion of the address electrode 201, the sealing portion 300 may directly contact a portion of the address electrode 201 not covered by the lower dielectric layer 203. This may prevent noise and a migration phenomenon generated when the address electrode 201 is exposed to air.

Other details of the plasma display panel can be found in U.S. Pat. Nos. 6,838,828 B2, 6,479,935, 6,680,573, 6,630,788, 6,621,230 B2, 6,906,690 B2, 6,791,516 B2, 6,624,587 B2, and 7,187,346, whose disclosures are incorporated herein by reference. Further, the embodiments disclosed herein can be readily applicable to display panels or plasma display panels made by various manufacturers.

Figure 7:
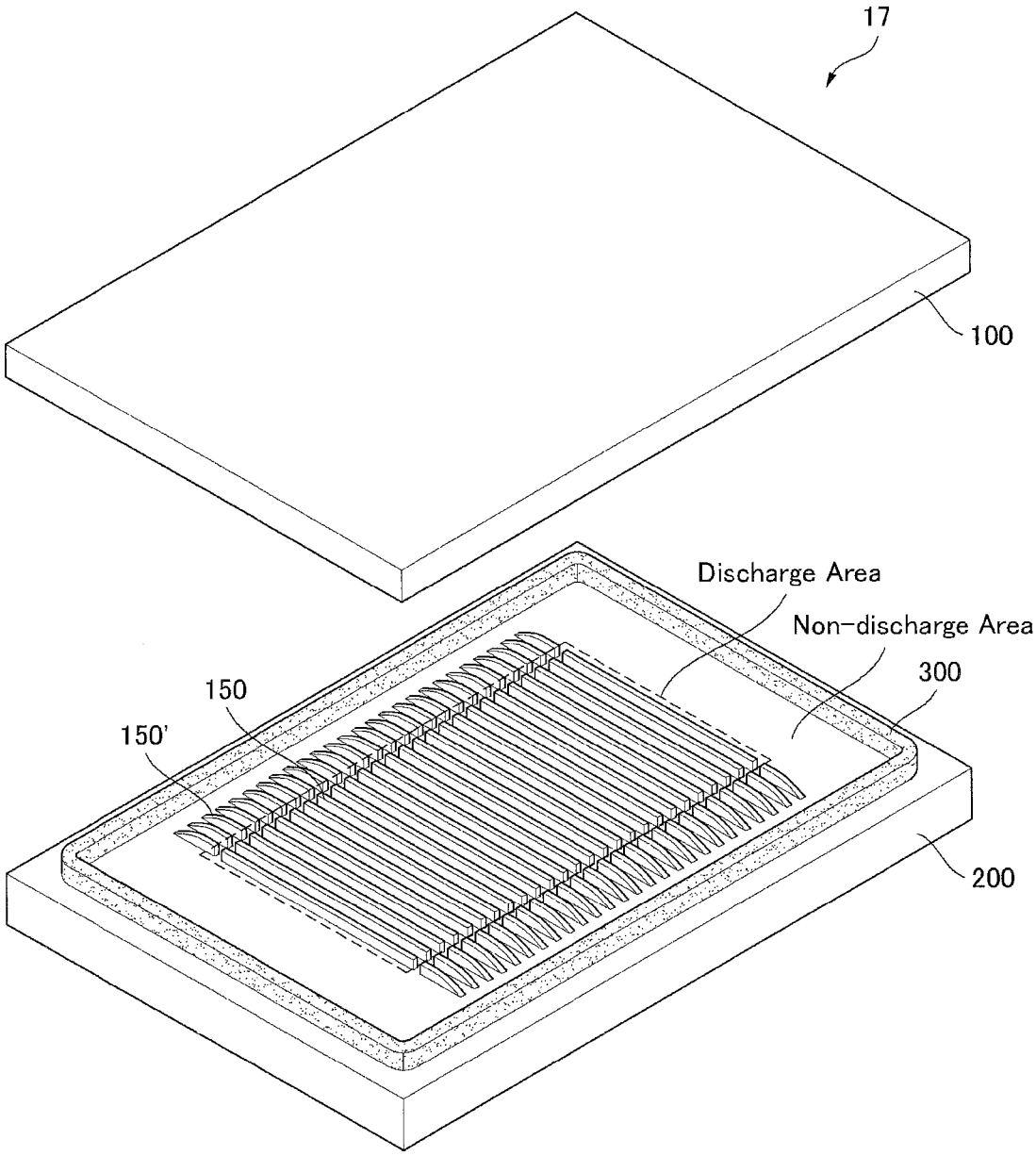
FIG. 7 is a perspective view of first barrier ribs of a plasma display panel according to another embodiment.

FIG. 7 is a perspective view of first barrier ribs of a plasma display panel according to another embodiment. As illustrated in FIG. 7, since the structure of the plasma display panel 17 according to this embodiment is substantially the same as the structure of the plasma display panel according to previous embodiments, like description thereof will be omitted. In this embodiment, an auxiliary barrier rib(s) 150' may be positioned between a first barrier rib 150 and a sealing portion 300 to be spaced apart from the first barrier rib 150 and the sealing portion 300 with a predetermined distance therebetween. Hence, noise generated when the plasma display panel 17 is driven may be prevented, and an exhaust characteristic improved.

A plasma display panel according to embodiments disclosed herein is capable of preventing noise generated when the plasma display panel is driven.

A plasma display panel according to embodiments disclosed herein is capable of preventing a reduction in an exhaust process characteristic and a reduction in a structural strength characteristic of a barrier rib, which may be generated when the structure of a barrier rib is improved for auxiliary.

A plasma display panel according to an embodiment disclosed herein may include a first substrate and a second substrate that are positioned parallel to each other and spaced apart from each other with a predetermined distance therebetween, a first or main barrier rib that is positioned between the first substrate and the second substrate and partitions a discharge area where an image is displayed, a sealing portion that attaches the first substrate to the second substrate, and an auxiliary barrier rib that is spaced apart from the sealing portion with a predetermined distance therebetween and is extended from the main barrier rib. The auxiliary barrier rib may include a portion with a height lower than a height of the first barrier rib positioned in the discharge area.

Implementations may include one or more of the following features. For example, the auxiliary barrier rib may have a gradually decreasing height as it goes toward the sealing portion. Further, the first barrier rib may include a plurality of first barrier rib portions positioned in a direction of a long side of the first substrate and the second substrate, and a plurality of second barrier rib portions positioned in a direction perpendicular to the first barrier rib portions. A height of the first barrier rib portion may be lower than a height of the second barrier rib portion, and the auxiliary barrier rib may include a portion with a height lower than the height of the first barrier rib portion. Also, at least one auxiliary barrier rib may be positioned in a non-discharge area in a direction parallel or perpendicular to the first barrier rib. The sealing portion may include beads. The sealing portion may include a first sealing portion positioned in a direction of a long side of the first substrate and the second substrate, and a second sealing portion positioned in a direction of a short side of the first substrate and the second substrate. A width of the first sealing portion may be smaller than a width of the second sealing portion.

A plasma display panel according to another embodiment disclosed herein may include a first substrate and a second substrate that are positioned parallel to each other and spaced apart from each other with a predetermined distance therebetween, a first or main barrier rib that is positioned between the first substrate and the second substrate and partitions a discharge area where an image is displayed, a sealing portion that attaches the first substrate to the second substrate, and an auxiliary barrier rib that is positioned parallel to the first barrier rib and is spaced apart from the sealing portion with a predetermined distance therebetween. The auxiliary barrier rib may have a substantially equal height over the entire portion of thereof. The number of auxiliary barrier ribs may be one or more. The auxiliary barrier rib may be positioned in a direction of at least one of a long side and a short side of the first substrate and the second substrate.

A plasma display panel according to another embodiment disclosed herein may include a first substrate and a second substrate that are positioned parallel to each other and spaced apart from each other with a predetermined distance therebetween, a first or main barrier rib that is positioned between the first substrate and the second substrate and partitions a discharge area where an image is displayed, a sealing portion that attaches the first substrate to the second substrate, and an auxiliary barrier rib that is positioned between the first barrier rib and the sealing portion and spaced apart from the first barrier rib and the sealing portion with a predetermined distance therebetween. The auxiliary barrier rib may include a portion with a height lower than a height of the first barrier rib.

The first barrier rib may include a plurality of first barrier rib portions positioned in a direction of a long side of the first substrate and the second substrate, and a plurality of second barrier rib portions positioned in a direction perpendicular to the first barrier rib portions. A height of the first barrier rib portion may be lower than a height of the second barrier rib portion. The auxiliary barrier rib may include a portion with a height lower than the height of the first barrier rib portion.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel, comprising:

a first substrate and a second substrate spaced apart from each other with a predetermined distance therebetween;

at least one first barrier rib positioned between the first substrate and the second substrate and that partitions a discharge area;

a sealing portion that attaches the first substrate to the second substrate; and at least one auxiliary barrier rib that extends substantially parallel to the at least one first barrier rib in a non-discharge area and is spaced apart from the sealing portion with a predetermined distance therebetween, the at least one auxiliary barrier rib having substantially a same height as the at least one first barrier rib and extending substantially a same length as the at least one first barrier rib, and wherein a height of the at least one auxiliary barrier rib adjacent to the sealing portion is less than a height of the at least one auxiliary barrier rib adjacent to the discharge area.

2. The plasma display panel of claim 1, wherein the at least one auxiliary barrier rib comprises two or more auxiliary barrier ribs.

3. The plasma display panel of claim 1, wherein the at least one auxiliary barrier rib extends substantially in a direction of at least one of a long side and a short side of the first substrate and the second substrate.

4. The plasma display panel of claim 1, wherein the at least one first barrier rib includes a first barrier rib portion that extends substantially in a direction of a long side of the first substrate and the second substrate, and a second barrier rib portion that extends in a direction substantially perpendicular to the at least one first barrier rib and having a height greater than a height of the at least one first barrier rib.

5. The plasma display panel of claim 4, wherein a height of the at least one auxiliary barrier rib is substantially equal to a height of the second barrier rib portion.

6. The plasma display panel of claim 1, further comprising a dummy area, in which a discharge does not occur, outside the discharge area.

7. The plasma display panel of claim 6, wherein the dummy area extends substantially in a direction of at least one of a long side or a short side of the first substrate and the second substrate.

8. The plasma display panel of claim. 1, wherein that at least one first barrier rib comprises a plurality of first harrier ribs.

9. The plasma display panel of claim 8, wherein the plurality of first barrier ribs comprises stripe-type, well-type, or lattice-type barrier ribs.

10. A plasma display panel, comprising:

a first substrate and a second substrate spaced apart from each other with a predetermined distance therebetween;

at least one first barrier rib positioned between the first substrate and the second substrate and that partitions a discharge area;

a sealing portion that attaches the first substrate to the second substrate; and at least one auxiliary barrier rib positioned between the at least one first barrier rib and the sealing portion in a non-discharge area and that is spaced apart from the at least one first barrier rib and the sealing portion with a predetermined distance therebetween, the at least one auxiliary barrier rib including a portion with a height lower than a height of the at least one first barrier rib, and wherein a height of the at least one auxiliary barrier rib adjacent to the sealing portion is less than a height of the at least one auxiliary barrier rib adjacent to the discharge area.

11. The plasma display panel of claim 10, wherein the at least one auxiliary barrier rib has a gradually decreasing height as it extends toward the sealing portion.

12. The plasma display panel of claim 10, wherein the at least one first barrier rib includes a plurality of first barrier rib portions that extend in a direction of a long side of the first substrate and the second substrate, and a plurality of second barrier rib portions that extend in a direction substantially perpendicular to the first barrier rib portions, and wherein a height of the first barrier rib portion is less than a height of the second barrier rib portion.

13. The plasma display panel of claim 10, wherein the at least one first barrier rib and the at least one auxiliary barrier rib are formed of a same material.

14. The plasma display panel of claim 10, further comprising a dummy area, in which a discharge does not occur, outside the discharge area.

15. The plasma display panel of claim 14, wherein the dummy area extends substantially in a direction of at least one of a long side or a short side of the first substrate and the second substrate.

16. The plasma display panel of claim 10, wherein the at least one first barrier rib comprises a plurality of first barrier ribs.

17. The plasma display panel of claim 16, wherein the plurality of first barrier ribs comprises stripe-type, well-type, or lattice-type barrier ribs.

18. A plasma display panel, comprising:

a first substrate and a second substrate spaced apart from each other with a predetermined distance therebetween;

at least one first barrier rib positioned between the first substrate and the second substrate and that partitions a discharge area;

a sealing portion that attaches the first substrate to the second substrate; and at least one auxiliary barrier rib positioned between the at least one first barrier rib and the sealing portion in a non-discharge area, wherein the at least one auxiliary barrier extends from the at least one first barrier rib and includes a portion with a height less than a height of the at least one first barrier rib, and wherein the sealing portion includes a first sealing portion that extends substantially in a direction of a long side of the first substrate and the second substrate, and a second sealing portion that extends substantially in a direction of a short side of the first substrate and the second substrate, and a distance from the second sealing portion to the at least one first barrier rib is greater than a distance from the first sealing portion to an end of the at least one first barrier rib.

19. The plasma display panel of claim 18, wherein a height of the at least one auxiliary barrier rib decreases stage by stage as the at least one auxiliary barrier rib extends toward the sealing portion.

20. The plasma display panel of claim 18, wherein the at least one auxiliary barrier rib has a gradually decreasing height as it extends toward the sealing portion.

21. The plasma display panel of claim 18, wherein the at least one first barrier rib extends substantially in a direction of the long side or the short side of the first substrate and the second substrate.

22. The plasma display panel of claim 18, further comprising a dummy area, in which a discharge does not occur, outside the discharge area.

23. The plasma display panel of claim 22, wherein the dummy area extends substantially in a direction of at least one of the long side or the short side of the first substrate and the second substrate.

24. The plasma display panel of claim 18, wherein the at least one first barrier rib includes a plurality of first barrier rib portions that extend substantially in a direction of the long side of the first substrate and the second substrate, and a plurality of second barrier rib portions that extend in a direction substantially perpendicular to the first barrier rib portions.

25. The plasma display panel of claim 24, wherein a height of the first barrier rib portion is less than a height of the second barrier rib portion, and wherein the at least one auxiliary barrier rib includes a portion with a height less than the height of the first barrier rib portions.

26. The plasma display panel of claim 24, wherein an outermost second barrier rib portion of the plurality of second barrier rib portions has a curvature in a direction of a non-discharge area.

27. The plasma display panel of claim 18, wherein at least one auxiliary barrier rib is positioned in a non-discharge area and extends in a direction substantially parallel or perpendicular to the at least one first barrier rib.

28. The plasma display panel of claim 18, wherein a dummy barrier rib is positioned between the at least one first barrier rib and the at least one auxiliary barrier rib.

29. The plasma display panel of claim 18, wherein the sealing portion includes beads.

30. The plasma display panel of claim 18, wherein a width of the first sealing portion is smaller than a width of the second sealing portion.

31. The plasma display panel of claim 30, wherein the sealing portion further includes a third corner sealing portion formed at a contact position of the first sealing portion and the second sealing portion, and wherein a width of the third corner sealing portion is larger than the width of the second sealing portion.

32. The plasma display panel of claim 31, wherein a ratio of a distance from a contact surface of the first sealing portion and the third corner sealing portion to an imaginary line extended from the second sealing portion to a distance from a contact surface of the second sealing portion and the third corner sealing portion to an imaginary line extended from the first sealing portion is 5:4.

33. The plasma display panel of claim 30, wherein a distance from the first sealing portion to an end of the at least one first barrier rib is about 2 to 10 times a distance from the first sealing portion to an end of the at least one auxiliary barrier rib extended from the at least one first barrier rib.

34. The plasma display panel of claim 33, wherein a length of the at least one auxiliary barrier rib extended from the at least one first barrier rib is longer than the distance from the first sealing portion to the end of the at least one auxiliary barrier rib.

35. The plasma display panel of claim 18, wherein the distance from the second sealing portion to the at least one first barrier rib is equal to or less than about 2.5 times longer than the distance from the first sealing portion to the end of the at least one first barrier rib.

36. The plasma display panel of claim 18, further comprising a plurality of scan electrodes and a plurality of sustain electrodes positioned parallel to one another on the first substrate, and an upper dielectric layer covering the plurality of scan electrodes and the plurality of sustain electrodes, wherein the sealing portion directly contacts the upper dielectric layer.

37. The plasma display panel of claim 18, further comprising a plurality of address electrodes positioned parallel to one another on the second substrate, and a lower dielectric layer covering the plurality of address electrodes, wherein the sealing portion directly contacts the lower dielectric layer.

38. The plasma display panel of claim 18, further comprising a plurality of address electrodes positioned parallel to one another on the second substrate, and a lower dielectric layer covering a portion of the plurality of address electrodes, wherein the sealing portion directly contacts a portion of the plurality of address electrodes not covered with the lower dielectric layer.

39. The plasma display panel of claim 18, wherein the at least one first barrier rib and the at least one auxiliary barrier rib are formed of a same material.

40. The plasma display panel of claim 18, wherein that at least one first barrier rib comprises a plurality of first barrier ribs.

41. The plasma display panel of claim 40, wherein the plurality of first barrier ribs comprises stripe-type, well-type, or lattice-type barrier ribs.

* * * * *